US006874916B2

(12) United States Patent
Wu

(10) Patent No.: US 6,874,916 B2
(45) Date of Patent: Apr. 5, 2005

(54) QUICKLY DETACHABLE LAMP ASSEMBLED DEVICE

(76) Inventor: Wen-Chang Wu, 235 Chung-Ho Box 8-24, Taipei (TW)

( * ) Notice: Subject to any disclaimer, the term of this patent is extended or adjusted under 35 U.S.C. 154(b) by 65 days.

(21) Appl. No.: 10/414,371

(22) Filed: Apr. 16, 2003

(65) Prior Publication Data

US 2004/0208010 A1 Oct. 21, 2004

(51) Int. Cl.[7] ..... F21S 8/06

(52) U.S. Cl. ..... 362/410; 362/226; 362/389; 362/406; 362/443

(58) Field of Search ..... 362/405, 226, 362/406, 277, 368, 374, 389, 431, 443, 452, 410

(56) References Cited

U.S. PATENT DOCUMENTS 5,632,553 A * 5/1997 Huang ..... 362/410

* cited by examiner

*Primary Examiner*—Sandra O'Shea
*Assistant Examiner*—Guiyoung Lee

(57) ABSTRACT

An easy detachable lamp assembly device comprises a lamp seat and a lamp rod. The wire winding box has a cover which is locked to the wire winding box through a screw rod, a spring and a washer; an inner surface of the cover is protruded with a plurality of blocks. A top of the lamp seat has an embedding hole for being embedded by a block of the cover. An end portion at a front end of the lamp rod is inserted into the inserting seat. A top of the lamp rod has a cut-in portion for buckling the block entering into the embedding hole. After the lamp rod is inserted into the lamp seat, the end portion of the lamp rod is inserted into the inserting seat so that the lamp seat is electrically conductive to the lamp rod. Thereby, the lamp is detachable for storage and transfer.

6 Claims, 6 Drawing Sheets

Fig 1-A

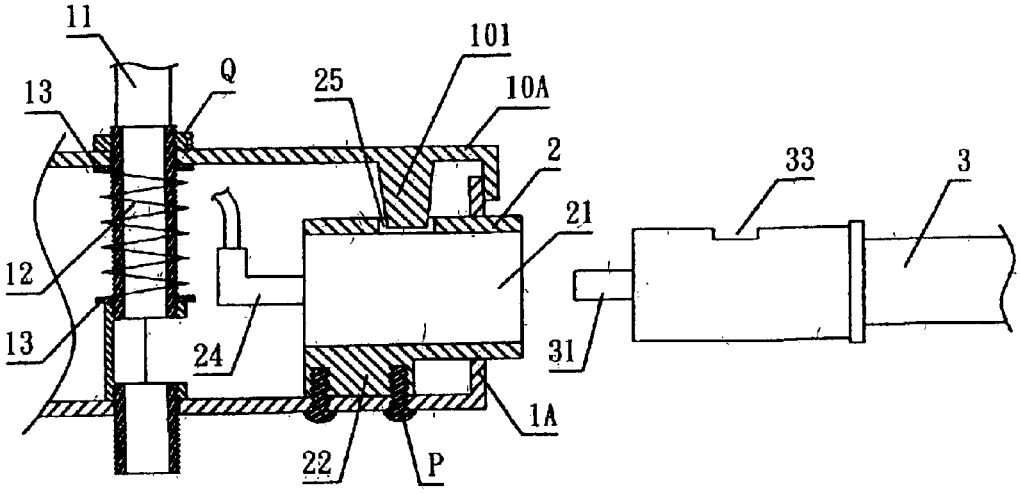
Fig. 3-A
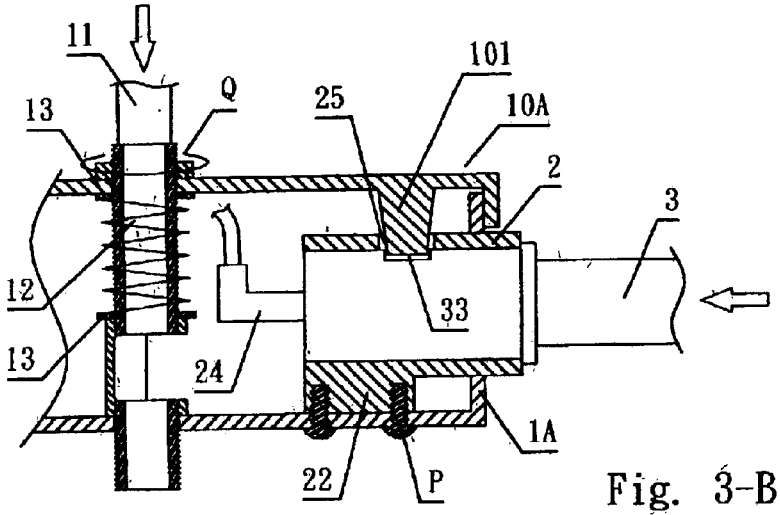
Fig. 3-B
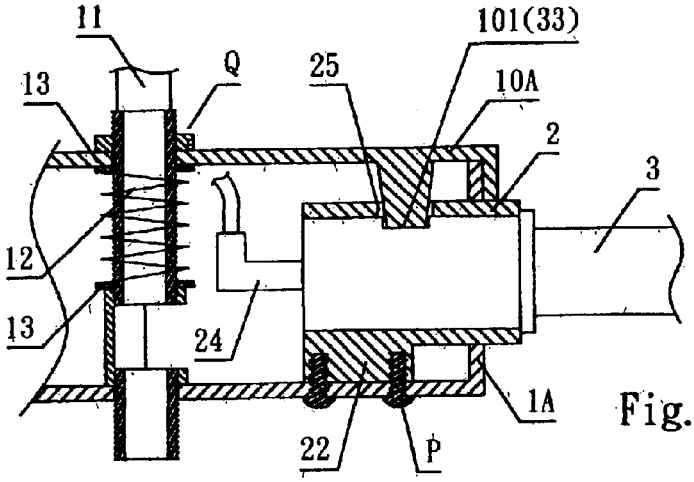
Fig. 3-C

QUICKLY DETACHABLE LAMP ASSEMBLED DEVICE

BACKGROUND OF THE INVENTION

The present invention relates to lamp assembly devices, and particularly to an easily detachable lamp assembled device. By the design of the present invention, a user can assemble the lamp rod by inserting it into the lamp seat easily; thus, the lamp is detachable for storage and transfer with a smaller volume.

The prior art buckling structures of lamps, such as wall lamps, seat lamps, or stand lamps, are assembled by screwing studs with nuts. Not only collision events easily occur, but also the locking tools (for example, spanners, openers, etc.) are necessarily used in assembly. In assembly, the wires will expose so as to generate electric shock. Moreover, the assembly work is tedious and thus it is unsuitable for being assembled by the users themselves. Thus generally, the wire winding box is assembled with the inserting rod before sale. Thereby, the cost is high and a larger space is necessary for transfer and storage.

SUMMARY OF THE INVENTION

Accordingly, the primary object of the present invention is to provide an easy detachable lamp assembly device which comprises a lamp seat at a lower edge of a wire winding box and a lamp rod inserted in the lamp seat. The wire winding box has a cover which is locked to the wire winding box through a screw rod, a spring and a washer; an inner surface of the cover is protruded with a plurality of blocks. A top of the lamp seat has an embedding hole for being embedded by a block of the cover. An end portion at a front end of the lamp rod is inserted into the inserting seat. A top of the lamp rod has a cut-in portion for buckling the block entering into the embedding hole; after the lamp rod is inserted into the lamp seat, the end portion of the lamp rod is inserted into the inserting seat so that the lamp seat is electrically conductive to the lamp rod. Thereby, a user can assemble the lamp rod by inserting it into the lamp seat easily; the lamp is detachable for storage and transfer with a smaller volume.

The various objects and advantages of the present invention will be more readily understood from the following detailed description when read in conjunction with the appended drawing.

BRIEF DESCRIPTION OF THE DRAWINGS

FIG. 1A shows an embodiment of cover different from that in FIG. 1.

FIG. 3A shows one embodiment of the present invention before the insertion of the lamp rod.

FIG. 3B shows the embodiment of FIG. 3A wherein the lamp rod is inserting.

FIG. 3C shows the embodiment of FIG. 3A after the insertion of the lamp rod.

BRIEF DESCRIPTION OF THE PREFERRED EMBODIMENTS

Figure 1:
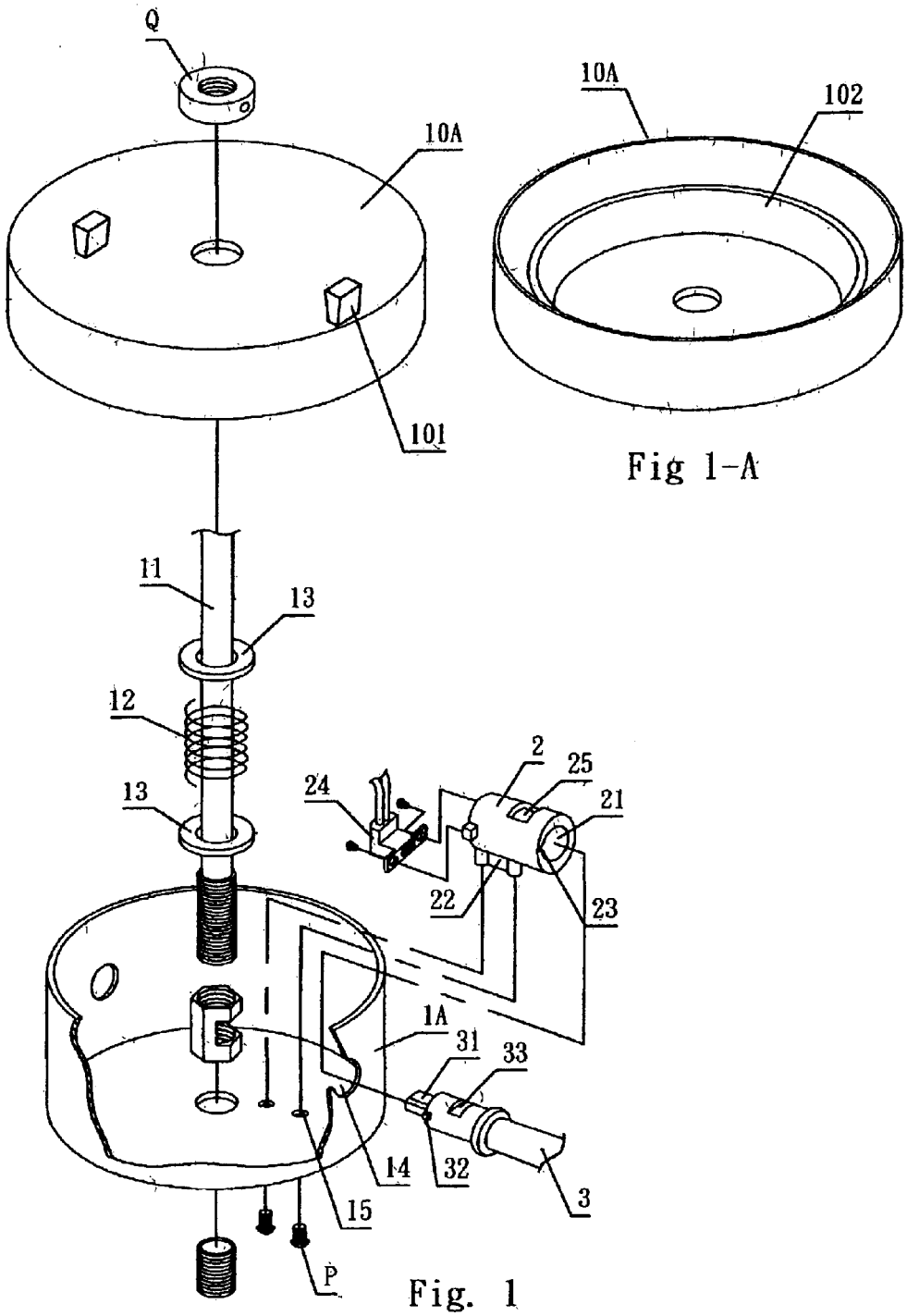
FIG. 1 is an exploded perspective view of the present invention.
Figure 2:
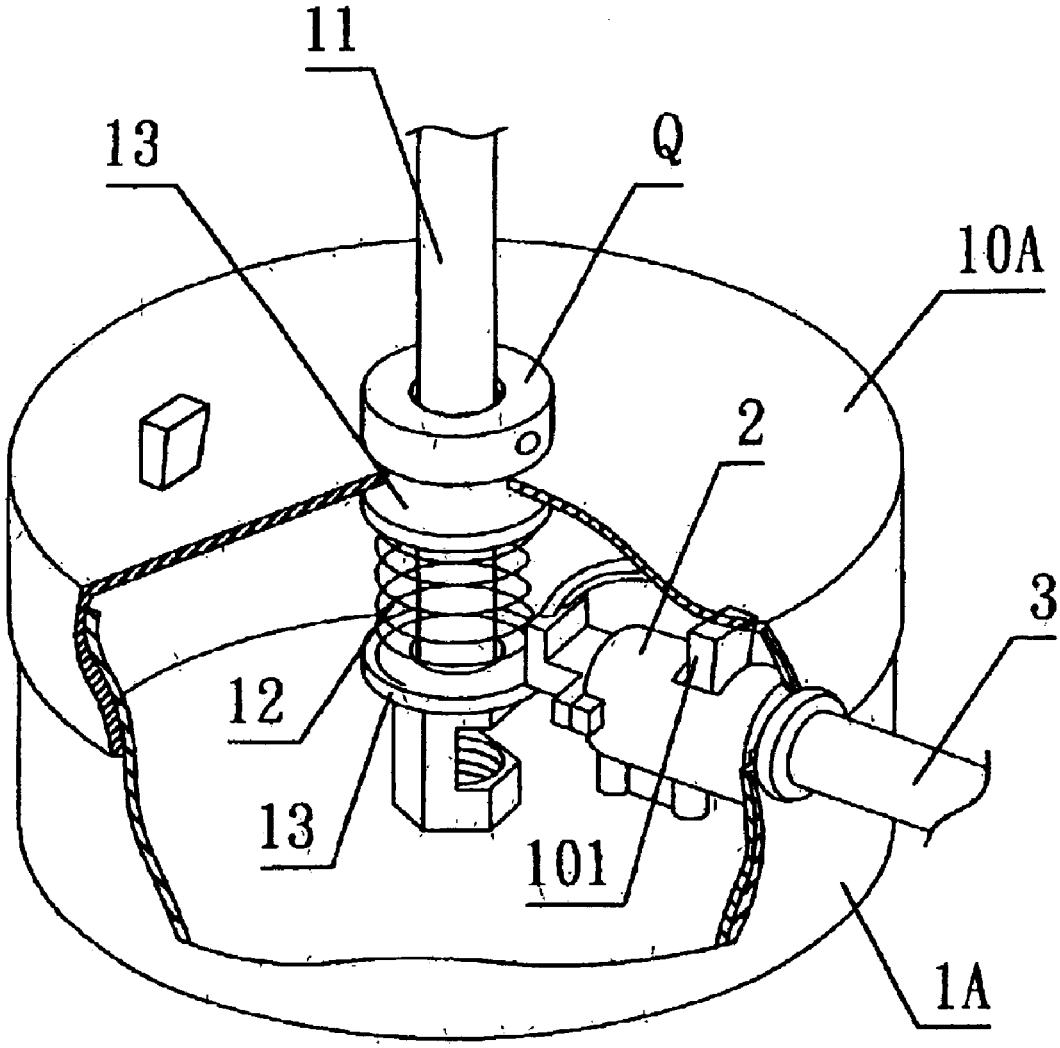
FIG. 2 is an assembled perspective view of the present invention.

Referring to FIGS. 1 and 2, the structure of the present invention is illustrated. The present invention includes a lamp seat 2 at a lower edge of a wire winding box 1A and a lamp rod 3 inserted in the lamp seat 2.

The wire winding box 1 has a cover 10A which is locked to the wire winding box 1A through a screw rod 11, a spring 12 and a washer 13. A lateral edge of the wire winding box 1A is formed with a via hole 14. A bottom of the wire winding box 1A coupled to the lamp seat 2 has at least through hole 15, in this embodiment, two through holes 15 are illustrated. Thereby, a stud P passes through the through hole 15 to lock the lamp seat 2 so as to fix the lamp seat 2. An inner surface of the cover 10A is protruded with a plurality of blocks 101. After the cover 10A is engaged to the wire winding box 1, the blocks 101 are exactly buckled to the lamp seat 2. Moreover, the blocks can be replaced by a ring 102 illustrated in FIG. 1A.

A portion of the lamp seat 2 coupled to the via hole 14 of the wire winding box 1 has a penetrating hole 21. A bottom of the lamp seat 2 has a locking seat 22. Thereby, studs P can pass through the through holes 15 from the lower side of the wire winding box 1A and then are locked to the locking seat 22 so that the lamp seat 2 is fixed to the interior of the wire winding box 1A. An inner surface of the penetrating hole 21 is formed with an axial recess 23 for buckling a lamp rod 3. A distal end of the lamp seat 2 is locked with an inserting seat 24 for positioning the end portion 31 of the lamp rod 3. A top of the lamp seat 2 has an embedding hole 25 for being embedded by a block 101 of the cover 10A.

A front end of the lamp rod 3 is exactly inserted into the end portion 31 in the inserting seat of the lamp seat 2, a portion of the lamp rod 3 is protruded with a positioning key 32 at a position corresponding to the axial recess 23 of the lamp seat 2. The positioning key 32 exactly passes through the axial recess 23 of the lamp seat 2. A top of the lamp rod 3 has a cut-in portion 33 for buckling the block 101 entering into the embedding hole 25. After the lamp rod 3 is inserted into the lamp seat 2, the end portion 31 of the lamp rod 3 is inserted into the inserting seat 24 so that the lamp seat 2 is electrically conductive to the lamp rod 3.

The assembly of the present invention will be described here. The lamp rod 3 is inserted into the penetrating hole 21 of the lamp rod 3 with the positioning key 32 being inserted into the axial recess 23. The cut-in portion 33 of the lamp rod 3 is aligned to the embedding hole 25 of the top surface of the lamp seat 2. Then, the wire winding box 1A is secured to the cover 10A so that the block 101 on the cover 10A exactly embeds into the embedding hole 25 of the lamp seat 2 and the cut-in portion 33 of the lamp rod 3. Then screw nut Q locks upon the screw rod so that the lamp rod 3 is positioned to the lamp seat 2.

Figure 4:
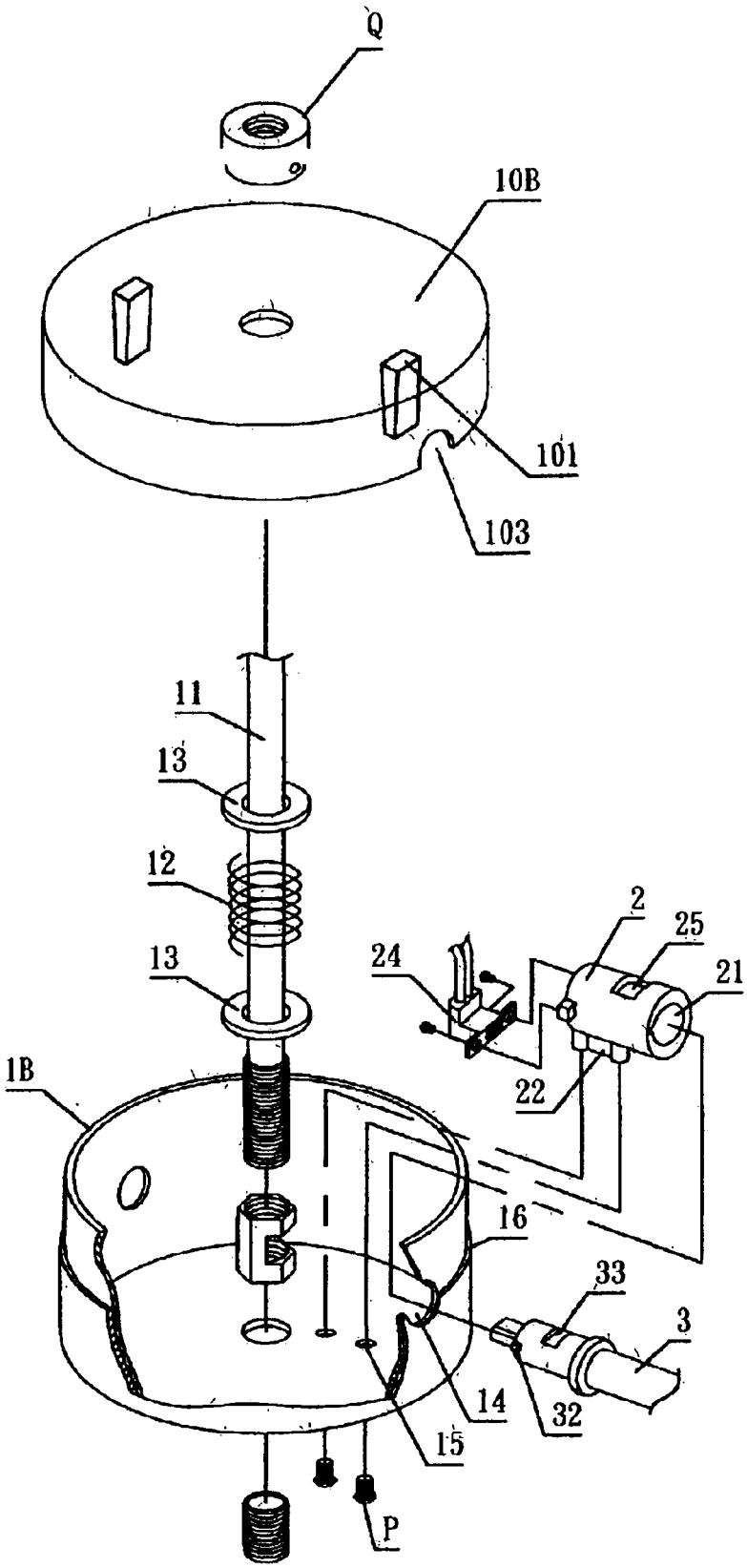
FIG. 4 shows another embodiment of the present invention.

With reference to FIG. 4, another embodiment of the present invention is illustrated. An outer surface of the wire winding box 1B has a stepped edge 16. The outer surface of the cover 10B covering upon the wire winding box 1B is flushed with the lower surface below the stepped edge 16. An edge of the cover 10B is installed with a round recess 103 for receiving the inserted lamp rod 3.

Figure 5:
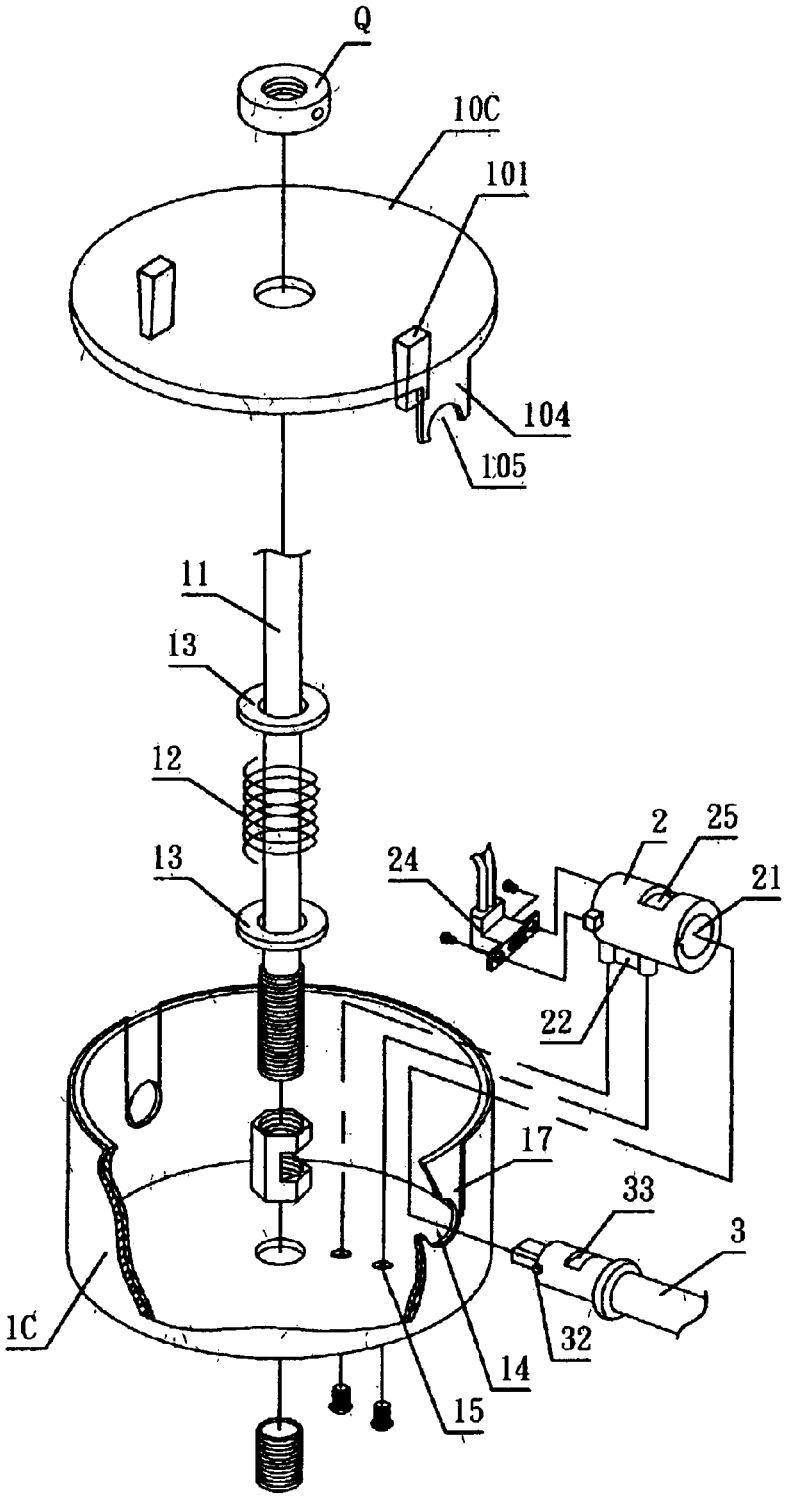
FIG. 5 shows a further embodiment of the present invention.

Referring to FIG. 5, the third embodiment of the present invention is illustrated. In this embodiment, a limiting piece 104 extending from the cover 10C. A lower edge of the limiting piece 104 is formed with a round recess 105. The round recess 105 is positioned to receive the inserted lamp rod 3. The outer surface of the wire winding box 1C is formed with a recess portion 17 for receiving the limiting piece 104. The lamp rod 3 is inserted into the wire winding box 1C and then the cover 10C covers the wire winding box 1C with the limiting piece 104 is placed in the recess portion 17.

Figure 6:
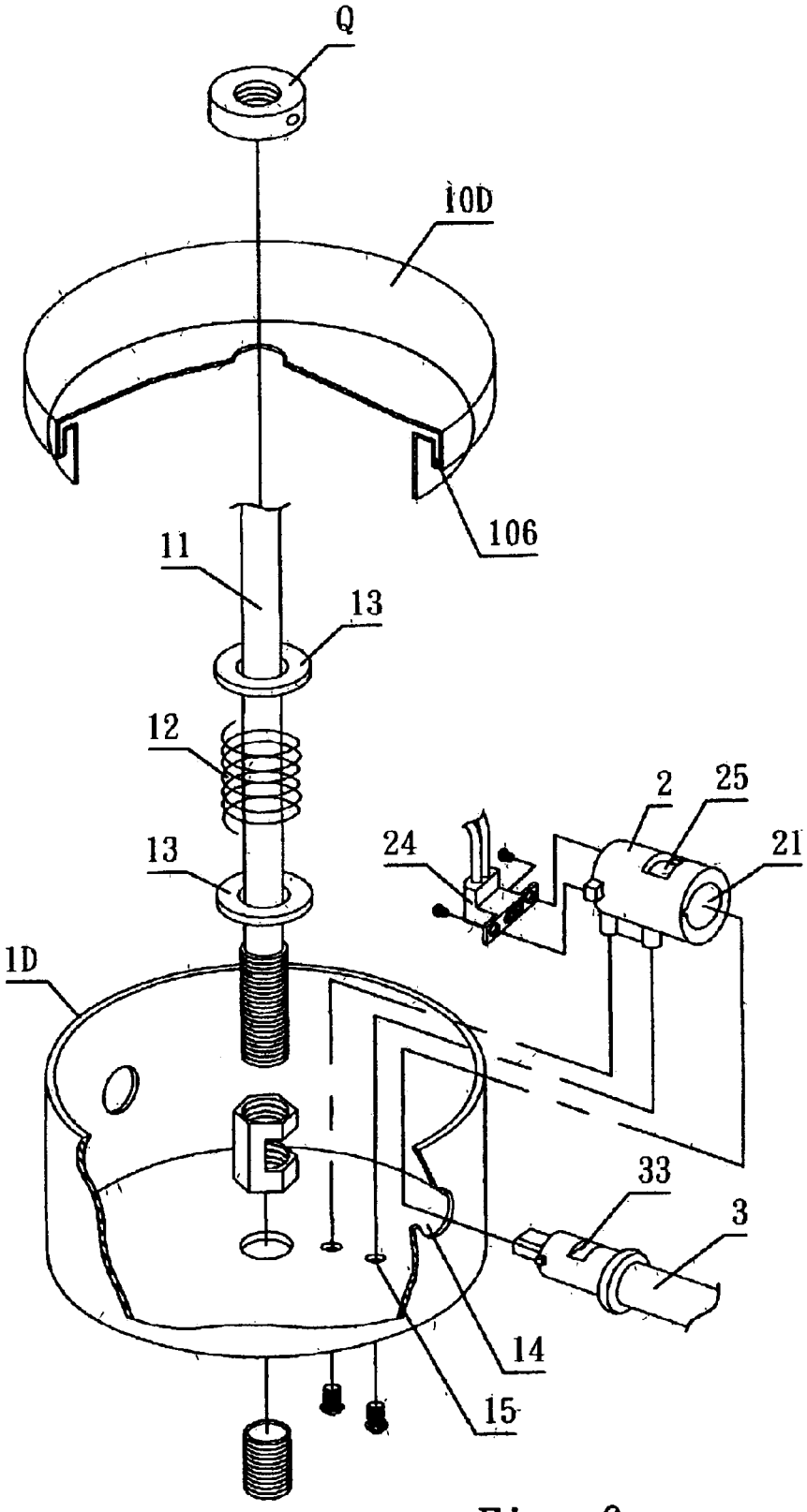
FIG. 6 shows a yet embodiment of the present invention.

Referring to FIG. 6, the fourth embodiment of the present invention is illustrated. The cover 10D is formed with a buckle 106. When the coyer 106 covers upon the wire winding box 1D, the buckle 106 is placed on the cut-in portion.

By above said structure, in transferring or storage, the lamp rod and the wire winding box 1 can be detached in advance so as to reduce the volume. In use, the user only needs to insert the lamp rod into the lamp seat 2 without using any locking tools. Thus, the user can assemble the lamp by himself (or herself).

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An easy detachable lamp assembly device comprising a lamp seat at a lower edge of a wire winding box and a lamp rod inserted in the lamp seat; wherein the wire winding box has a cover which is locked to the wire winding box through a screw rod, a spring and a washer; an inner surface of the cover is protruded with a plurality of blocks; after the cover covers the wire winding box, the blocks is exactly buckled to the lamp seat;

a lateral edge of the wire winding box is formed with a via hole; a portion of the lamp seat coupled to the via hole of the wire winding box has a penetrating hole; a bottom of the lamp seat has a locking seat; thereby the lamp seat is fixed to the interior of the wire winding box; a distal end of the lamp seat is locked with an inserting seat for positioning the end portion of the lamp rod; a top of the lamp seat has an embedding hole for being embedded by one of the plurality of block of the cover;

an end portion at a front end of the lamp rod is inserted into the inserting seat; a top of the lamp rod has a cut-in portion for buckling the block entering into the embedding hole; after the lamp rod is inserted into the lamp seat, the end portion of the lamp rod is inserted into the inserting seat so that the lamp seat is electrically conductive to the lamp rod;

thereby, a user can assemble the lamp rod by inserting it into the lamp seat easily; the lamp is detachable for storage and transfer with a smaller volume;

wherein an outer surface of the wire winding box has astepped edge; the outer surface of the cover covering upon the wire winding box is flushed with a lower surface of the wire winding box below the stepped edge; an edge of the cover is installed with a round recess for receiving the inserted lamp rod.

2. An easy detachable lamp assembly device comprising a lamp seat at a lower edge of a wire winding box and a lamp rod inserted, in the lamp seat; wherein the wire winding box has a cover which is locked to the wire winding box through a screw rod, a spring and a washer; an inner surface of the cover is protruded with a plurality of blocks; after the cover covers the wire winding box, the blocks is exactly buckled to the lamp seat;

a lateral edge of the wire winding box is formed with a via hole; a portion of the lamp seat coupled to the via hole of the wire winding box has a penetrating hole; a bottom of the lamp seat has a locking seat; thereby the lamp seat is fixed to the interior of the wire winding box; a distal end of the lamp swat is locked with an inserting seat for positioning the end portion of the lamp rod; a top of the lamp seat has an embedding hole for being embedded by one of the plurality of block of the cover;

an end portion at a front end of the lamp rod in inserted into the inserting seat; a top of the lamp rod has a cut-in portion for buckling the block entering into the embedding hole; after the lamp rod is inserted into the lamp seat, the end portion of the lamp rod is inserted into the inserting seat so that the lamp seat is electrically conductive to the lamp rod;

thereby, a user can assemble the lamp rod by inserting it into the lamp seat easily; the lamp is detachable for storage and transfer with a smaller volume, wherein a limiting piece extending from the cover; a lower edge of the limiting piece is formed with a round recess; the round recess is positioned to receive the inserted lamp rod; an outer surface of the wire winding box is formed with a recess portion for receiving the limiting piece.

3. An easy detachable lamp assembly device comprising a lamp seat at a lower edge of a wire winding box and a lamp rod inserted in the lamp seat; wherein the wire winding box has a cover which is locked to the wire winding box through a screw rod, a spring and a washer; an inner surface of the cover is protruded with a plurality of blocks; after the cover covers the wire winding box, the blocks is exactly buckled to the lamp seat;

a lateral edge of the wire winding box is formed with a via hole; a portion of the lamp seat coupled to the via hole of the wire winding box has a penetrating hole; a bottom of the lamp seat has a locking seat; thereby the lamp seat is fixed to the interior of the wire winding box; a distal end of the lamp seat is looked with an inserting seat for positioning the end portion of the lamp rod; a top of the lamp seat has an embedding hole for being embedded by one of the plurality of block of the cover;

an end portion at a front end of the lamp rod is inserted into the inserting seat; a top of the lamp rod has a cut-in portion for buckling the block entering into the embedding hole; after the lamp rod is inserted into the lamp seat, the end portion of the lamp rod is inserted into the inserting seat so that the lamp seat is electrically conductive to the lamp rod;

thereby, a user can assemble the lamp rod by inserting it into the lamp seat easily; the lamp is detachable for storage and transfer with a smaller volume;

wherein the cover is formed with a buckle; when the cover covers upon the wire winding box, the buckle is placed on the cut-in portion.

4. The detachable lamp assembled device as claimed in claim 3, wherein an inner surface of the penetrating hole is formed with an axial recess; a portion of the lamp rod is protruded with a positioning key at a position corresponding to the axial recess of the lamp seat; the positioning key exactly passes through the axial recess of the lamp seat.

5. The detachable lamp assembled device as claimed in claim 3, wherein a bottom of the, wire winding box coupled to the lamp seat has at least through hole, and studs passes through the at least through hole to lock the lamp seat.

6. The detachable lamp assembled device as claimed in claim 3, wherein the blocks are extended as rings attached on an inner surface of the cover.

* * * * *